United States Patent [19]

Weiler et al.

[11] 4,436,210

[45] Mar. 13, 1984

[54] THREADED CAP FOR SEVERING A CLOSURE FROM A HERMETICALLY SEALED CONTAINER

[75] Inventors: Gerhard H. Weiler, South Barrington; Louis T. Pagels, Hanover Park, both of Ill.

[73] Assignee: Automatic Liquid Packaging, Inc., Arlington Heights, Ill.

[21] Appl. No.: 364,476

[22] Filed: Apr. 1, 1982

[51] Int. Cl.[3] ..... B65D 1/02

[52] U.S. Cl. ..... 215/32

[58] Field of Search ..... 215/32, 250, 253, 251

[56] References Cited

U.S. PATENT DOCUMENTS

| | | | |
|---|---|---|---|
| 2,140,732 | 12/1938 | Burke | 215/251 |
| 3,804,282 | 4/1974 | Komendowski | 215/32 |
| 3,945,525 | 3/1976 | Jones | 215/32 |
| 4,051,972 | 10/1977 | Botkin | 215/329 X |

*Primary Examiner*—Donald F. Norton

*Attorney, Agent, or Firm*—Dressler, Goldsmith, Shore, Sutker & Milnamow, Ltd.

[57] ABSTRACT

A cap threadedly receivable on a severable cover of a hermetically sealed container is provided. The cap has a reduced surface area for engaging an annular bearing surface of the container. Screwing the cap further down onto the container transmits oppositely directed forces to the container body and to the container cover, thereby severing the cover from the body.

4 Claims, 7 Drawing Figures

THREADED CAP FOR SEVERING A CLOSURE FROM A HERMETICALLY SEALED CONTAINER

TECHNICAL FIELD OF THE INVENTION

This invention relates to improved plastic containers and more particularly to improved hermetically sealed plastic containers having a cap associated therewith which, upon being manipulated as by screwing, is adapted to open the container. More specifically, the invention is an improvement over the constructions shown in U.S. Pat. No. 3,804,282 that is assigned to the assignee of the present invention.

BACKGROUND OF THE INVENTION

As described in the above-discussed U.S. Pat. No. 3,804,282, a wide variety of products are now packaged in hermetically sealed plastic containers. The patent discloses a construction for a sealed plastic container that facilitates the opening of the container. The container includes a threaded cap and both the container and the cap (when screwed onto the container) appear visually to be generally conventional in all respects. By manipulating the cap, however, the user can cause the cap and container to coact and thereby open the container by severing a top or cover portion of the container from the remaining body portion at a weakened frangible web connection.

Operation of such a prior construction is briefly as follows. At the point of manufacture, the container is filled with the product, hermetically sealed, and the cap threaded onto the container neck or cover in the usual manner. To open the container, the user threadedly manipulates the cap to screw it further down onto the container. This causes an annular shoulder of the cap to bear against a mating annular shoulder on the container body portion to sever the cover.

While the described prior construction represented a notable advancement of the art, it was found that the force required to manipulate the cap and open the container sometimes became annoyingly excessive. The inventors of the present invention have determined that such increased required manipulating force resulted, to a large extent, from the relatively high frictional engagement between the coacting annular shoulders over their entire planar surface areas of contact. The degree of frictional resistance was related to, among other things, the annular shoulder areas and the coefficient of friction of the plastic materials employed.

Accordingly, the inventors of the present invention determined that it would be desirable to provide an improved plastic container and cap construction in which the frictional resistance between cap and container during the opening manipulation is greatly reduced.

Further it would be beneficial to provide a container and cap construction of the character described which is adapted to be readily opened without the need of any additional implements.

It would also be advantageous to provide a container and cap construction of the character described which is simple in construction and operation and yet is inexpensive.

U.S. Pat. No. 4,051,972 shows a container cap having an undulating bottom edge. However, that cap is designed for use with glass containers or "Mason Jars" and the purpose of the undulating edge is to facilitate the passage of gases out of the jar during heating and preserving. There is no teaching that such a construction can be used with a severable container and in the manner of the present invention.

SUMMARY OF THE INVENTION

In accordance with the teachings of the present invention, a plastic cap and container is provided which, in some respects, is similar in structure and operation to that shown in the above-discussed U.S. Pat. No. 3,804,282. The cap structure differs, however, in that its bottom edge or bearing surface is discontinuous (relative to the contacted container shoulder) and has a scalloped configuration. The surface area contact between the bottom bearing surface or edge of the cap and the container annular shoulder is thereby greatly reduced with a concomitant reduction in frictional resistance during manipulation. Modifications of the scalloped cap bottom edge are also disclosed.

Other features and advantages of the invention will be apparent from the following detailed disclosure, taken in conjunction with the accompanying drawings.

BRIEF DESCRIPTION OF THE DRAWINGS

In the accompanying drawings, wherein like reference numerals refer to like parts.

DESCRIPTION OF THE PREFERRED EMBODIMENTS

Figure 1:
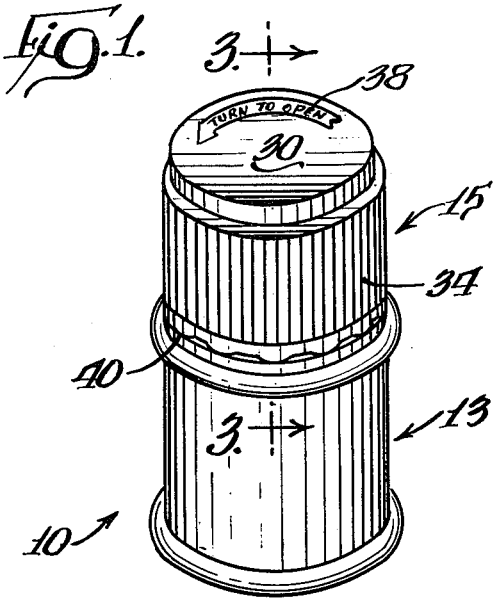
FIG. 1 is a perspective view of a sealed container and cap construction embodying the principles of the present invention.
Figure 2:
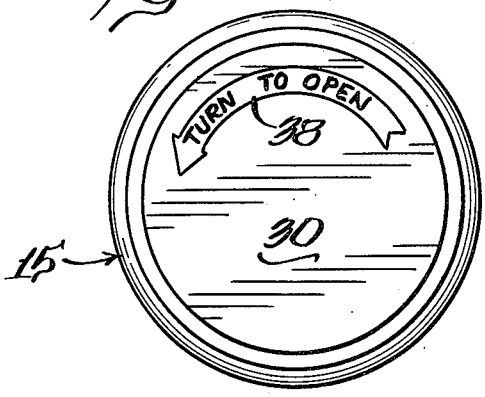
FIG. 2 is a top plan view of the container and cap construction of FIG. 1.

Turning now in greater detail to the drawings, and especially to FIG. 1, the reference character 10 indicates generally an improved package comprising a plastic container 13 and a cooperating cap 15 embodying the principals of the invention.

Figure 3:
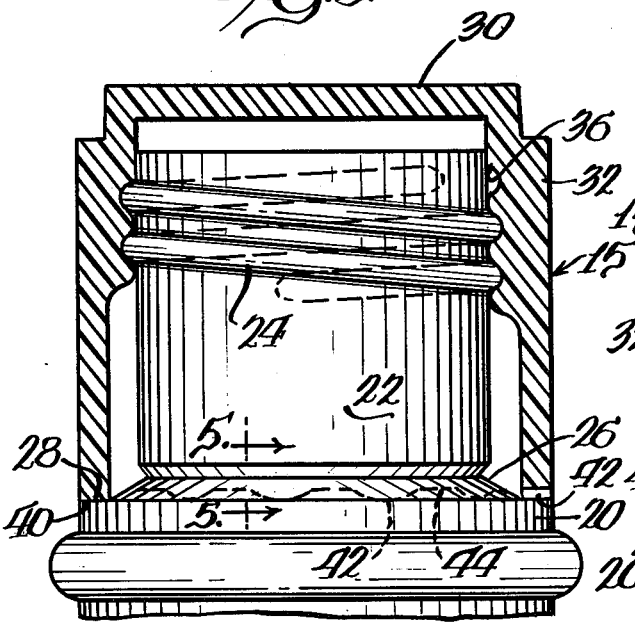
FIG. 3 is an enlarged, fragmentary, cross-sectional view taken substantially on the plane of line 3—3 in FIG. 1.
Figure 4:
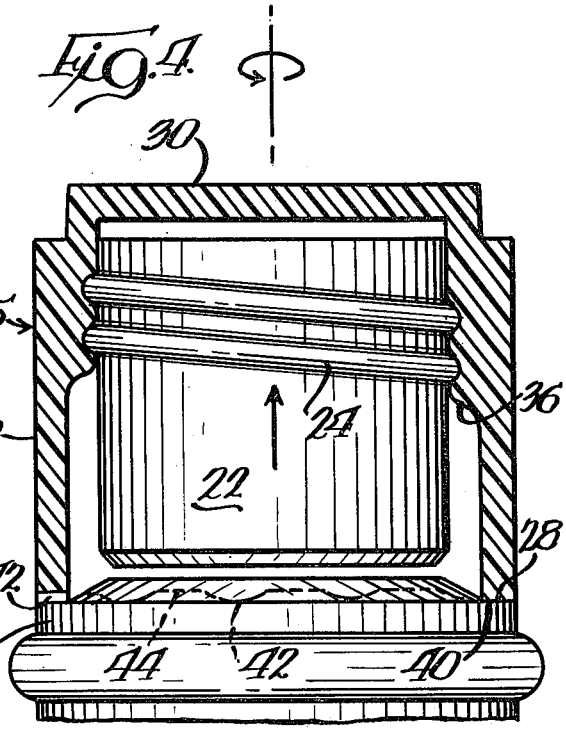
FIG. 4 is a view similar to FIG. 3, but shows the container cover after manipulation of the cap to sever the cover of the container.

Container 13 comprises a lower body portion 20 and an integrally formed neck, cover, or cover portion 22 (see FIGS. 3 and 4). Cover 22 is formed with external threading 24 and the cover is integral with the body portion 20 and joined therewith by a weakened connection or undercut region 26. Body portion 20 is also formed with an annular shoulder presenting a generally planar, upwardly facing, bearing surface 28.

The cap 15 comprises the conventional top wall 30 and an annular peripheral sidewall or depending skirt 32 formed with suitable exterior ribbing 34 (FIG. 1) to afford good hand purchase. Interiorly, the skirt 32 is formed with threading 36 (FIG. 3) complementary to the threading 24 on the container cover portion 22. Top wall 30 may also carry operating instructions such as at 38.

Figure 5:
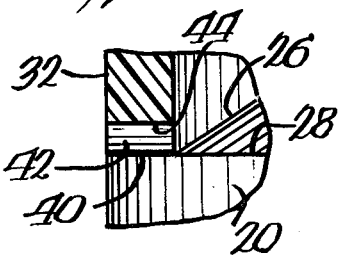
FIG. 5 is a greatly enlarged, fragmentary, cross-sectional view taken on the plane of line 5—5 in FIG. 3.

The skirt 32 of cap 15 terminates in a bottom bearing surface or edge 40 which is scalloped as illustrated rather than conventionally planar. In the preferred embodiment shown, bottom edge 40 has a generally undulating configuration and has arcuate prominences 42 and recesses 44 (see FIG. 5). The deepest portion of each recess 44 is illustrated as a band, i.e., a flat, downwardly facing, surface. However, the entire recess 44 may be defined by a continuously arcuate surface if desired.

Only the prominences 42 make contact with the container shoulder bearing surface 28 and that contact for each such prominence is substantially tangential at a single radially-extending line or band, or a small region, for each prominence because of the arcuate shape of the prominences 42. It will thus be appreciated that the area of surface contact between the cover 15 and the shoulder bearing surface 28 of container 13 is thereby minimized or greatly reduced with an attendant reduction in friction.

In operation, the assembled container 10 is packaged with the cap 15 threadedly engaged on the cover portion 22 as illustrated in FIG. 3. To open the container, the cap 15 is simply manipulated to screw it down onto the container, to abut the prominences 42 against the annular shoulder bearing surface 28.

As the cap 15 continues to be threaded downwardly, part of the threading torque is transmitted as oppositely-directed reaction forces to the container body portion 20 and the cover portion 22. The cover portion 22 is thus caused to be severed from the body portion 20 as shown in FIG. 4.

As illustrated in FIG. 4, the cap and container construction may be designed so that the described opening operation requires but a one-quarter, or 90 degree, turn of the cap 15 and that quarter turn is further facilitated by the reduced frictional resistance.

It should be appreciated that, although the invention has been illustrated with a cap bottom edge 40 having alternating circumferentially spaced prominences 42 and recesses 44 each numbering in the range of about 8 to about 10, the number of prominences and recesses could be reduced to as few as two or three each depending on package characteristics and requirements. Also, the prominences could comprise surface configurations other than the preferred arcuate form shown and described, it being necessary only that the prominences, in conjunction with the recesses, provide a broken or discontinuous engaging surface for engaging the annular container shoulder bearing surface.

Figure 6:
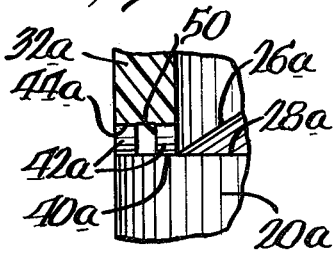
FIG. 6 is a view similar to FIG. 5 showing a modification of the cap bottom edge structure.
Figure 7:
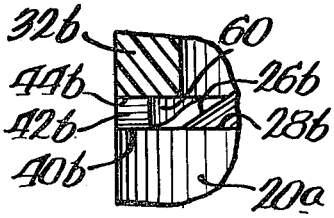
FIG. 7 is a view similar to FIG. 5 showing another modification of the cap bottom edge structure.

In FIGS. 6 and 7 there are illustrated modifications of the invention designed to reduce even further the surface area contact between the cap and container. Structural elements of the modifications in FIGS. 6 and 7 that are similar or analogous to the elements of the embodiment illustrated in FIGS. 1–5 are designated with the same reference numerals bearing the suffixes "a" and "b", respectively.

In FIG. 6, cap peripheral sidewall or skirt **32*a* comprises a scalloped bottom edge 40*a* having curved or arcuate prominences 42*a*. A mid-portion of each prominence 42*a* has been removed to provide a central circumferential groove 50** in the cap bottom edge.

In FIG. 7, cap skirt **32*b* comprises a scalloped bottom edge 40*b* having curved or arcuate prominences 42*b*. A portion of each prominence 42*b* has been removed to provide an inner circumferential opening, channel, or groove 60 in the cap bottom edge, which channel 60** opens to the interior of the cap.

It will likewise be appreciated that the grooves 50 and 60 can be varied in width as desired, subject only to the requirement of leaving a sufficient wall thickness at each prominence 42 so that scoring or cutting of the abutted container surfaces is avoided.

Caps embodying the present invention can be made from various thermoplastic materials of construction, such as polyethylene, acrylomitrite-butadiene-styrene (ABS) polymers, and the like, utilizing, for example, injection molding techniques.

It will be understood that modifications and variation may be effected in the disclosed embodiments without departing from the spirit and scope of the novel concepts of the present invention. For example, the molded caps may be provided with metal inserts or subjected to secondary operations such as painting, vacuum, metallizing, not stamping, and the like.

What is claimed is:

1. A sealed package comprising:

a hermetically sealed plastic container having a body portion provided with an annular bearing surface and a cover integral therewith but adapted to be severed therefrom; and a cap threadedly engaged with said cover and operable to sever said cover from said body portion when said cap is threaded down on said container to abut the bearing surface and thereby open said container;

said cap defining a discontinuous bottom edge adapted to bear against said container annular bearing surface as the cap is threaded down onto said container, whereby the surface area contact between said bottom edge and shoulder is substantially reduced;

said bottom edge further comprising a plurality of alternating circumferentially spaced prominences and recesses, only said prominences being adapted to bear against said annular bearing surface of said container; and said prominences being arcuate so that the surface area contact between a prominence and said container annular bearing surface is substantially tangential.

2. A sealed package comprising:

a hermetically sealed plastic container having a body portion provided with an annular bearing surface and a cover integral therewith but adapted to be severed therefrom; and a cap threadedly engaged with said cover and operable to sever said cover from said body portion when said cap is threaded down on said container to abut the bearing surface and thereby open said container;

said cap defining a discontinuous bottom edge adapted to bear against said container annular bearing surface as the cap is threaded down onto said container, whereby the surface area contact between said bottom edge and shoulder is substantially reduced;

said bottom edge comprising a plurality of alternating circumferentially spaced prominences and recesses so that only said prominences are adapted to bear against said annular bearing surface of said container; and said prominences define a circumferential groove disposed centrally of the thickness thereof.

3. A sealed package comprising:

a hermetically sealed plastic container having a body portion provided with an annular bearing surface and a cover integral therewith but adapted to be severed therefrom; and a cap threadedly engaged with said cover and operable to sever said cover from said body portion when said cap is threaded down on said container to abut the bearing surface and thereby open said container;

said cap defining a discontinuous bottom edge adapted to bear against said container annular bearing surface as the cap is threaded down onto said container, whereby the surface area contact between said bottom edge and shoulder is substantially reduced;

said bottom edge comprising a plurality of alternating circumferentially spaced prominences and recesses so that only said prominences are adapted to bear against said annular bearing surface of said container; and said prominences define a circumferential channel opening to the interior of said cap.

4. A sealed package comprising:

a hermetically sealed plastic container having a body portion provided with an annular bearing surface and a cover integral therewith but adapted to be severed therefrom; and a cap threadedly engaged with said cover and operable to sever said cover from said body portion when said cap is threaded down on said container to abut the bearing surface and thereby open said container;

said cap defining a discontinuous bottom edge adapted to bear against and engage said container annular bearing surface as the cap is threaded down onto said container and comprising a plurality of spaced-apart arcuate prominences, whereby the surface area contact between said bottom edge and shoulder is substantially reduced.

* * * * *